US007401874B2

(12) United States Patent
Kunschke

(10) Patent No.: US 7,401,874 B2
(45) Date of Patent: Jul. 22, 2008

(54) CODER ASSEMBLY

(75) Inventor: Andreas G. Kunschke, New Berlin, WI (US)

(73) Assignee: KHS USA, Inc., Waukesha, WI (US)

( * ) Notice: Subject to any disclaimer, the term of this patent is extended or adjusted under 35 U.S.C. 154(b) by 508 days.

(21) Appl. No.: 10/806,648

(22) Filed: Mar. 23, 2004

(65) Prior Publication Data

US 2005/0212828 A1 Sep. 29, 2005

(51) Int. Cl.

| | |
|---|---|
| ***B41J 3/00*** | (2006.01) |
| ***B41J 2/47*** | (2006.01) |
| ***B41J 2/435*** | (2006.01) |
| ***G01D 15/14*** | (2006.01) |

(52) U.S. Cl. ..... 347/2; 347/264; 347/225

(58) Field of Classification Search ..... 347/2, 347/264, 225

See application file for complete search history.

(56) References Cited

U.S. PATENT DOCUMENTS

| | | | | | |
|---|---|---|---|---|---|
| 1,889,246 | A | * | 11/1932 | Hoffman | 33/19.1 |
| 2,150,522 | A | * | 3/1939 | Shurley et al. | 101/115 |
| 2,199,255 | A | * | 4/1940 | Creamer | 101/335 |
| 2,242,974 | A | * | 5/1941 | Holm | 156/571 |
| 2,724,329 | A | * | 11/1955 | Lucas | 101/126 |
| 2,731,913 | A | * | 1/1956 | Carter | 101/305 |
| 3,220,344 | A | * | 11/1965 | Hagerman | 101/124 |
| 3,519,835 | A | * | 7/1970 | Davies | 250/223 R |
| 3,891,324 | A | * | 6/1975 | Davies | 356/615 |
| 3,960,072 | A | * | 6/1976 | Ahlgren et al. | 101/35 |
| 4,000,690 | A | * | 1/1977 | Geurtsen et al. | 101/36 |
| 4,098,183 | A | * | 7/1978 | Johnson | 101/40 |
| 4,304,180 | A | * | 12/1981 | Lala et al. | 101/40 |
| 4,566,382 | A | * | 1/1986 | Bronson et al. | 101/35 |
| 4,936,208 | A | * | 6/1990 | Tielrooy | 101/40 |
| 6,135,654 | A | * | 10/2000 | Jennel | 400/61 |
| 6,469,729 | B1 | * | 10/2002 | Ryan | 347/248 |

FOREIGN PATENT DOCUMENTS

| | | |
|---|---|---|
| DE | 299 14 034 | 12/1999 |

OTHER PUBLICATIONS

Industrial Dynamics Company, Ltd. "LASETEC Laser Printing System" Product Brochure.

Fig. A: Photograph of a pivotable connection known to be used in prior art labeler assemblies.

Fig. B: Photograph of a latch mechanism known to be used in prior art labeler assemblies.

Fig. C: Photograph of a latch mechanism known to be used in prior art labeler assemblies.

Fig. D: Photograph of an adjustment mechanism known to be used in prior art labeler assemblies.

* cited by examiner

*Primary Examiner*—Stephen D. Meier
*Assistant Examiner*—Leonard S Liang
(74) *Attorney, Agent, or Firm*—Michael Best & Friedrich LLP

(57) ABSTRACT

A coder assembly for printing on containers or on labels that can be applied to containers. The coder assembly includes a base, a support member movably coupled to the base, and a coder supported by the support member and movable with the support member relative to the base.

28 Claims, 8 Drawing Sheets

CODER ASSEMBLY

FIELD OF THE INVENTION

This invention relates generally to coder assemblies, and more particularly to laser coder assemblies adapted to imprint containers or labels that can be applied to containers.

BACKGROUND OF THE INVENTION

Coders are known and utilized in the bottling industry to imprint labels that are affixed to bottles. Typically, laser coders or ink jet coders are used to imprint information specific to the bottles on which the labels are applied. Such information may include, for example, the particular bottling date (i.e., the "born-on" date) of the beverage contained in the bottle. The coder may be positioned in a bottling machine such that labels are imprinted before being applied to the bottles, or the coder may be positioned in the bottling machine such that the labels are imprinted after they are applied to the bottles. In such an application where labels are imprinted before they are applied to the bottles, the coder is typically positioned with a labeler assembly, which typically singulates labels from a stack of labels.

Both the coder and the labeler assembly are typically supported on a machine surface, which is the top surface of the bottling machine, and which is elevated from a floor on which the entire bottling machine is situated. The coder is typically mounted to an adjustment mechanism that permits adjustment of the coder with respect to the labels to be imprinted. The adjustment mechanism, in turn, is typically mounted to a base situated on the machine surface.

During operation of the bottling machine, the lens of a laser coder may become contaminated, thus necessitating access to the lens for cleaning. To gain access to the lens of the laser coder for cleaning, a labor-intensive process must be performed, including disconnecting or unbolting the base of the laser coder from the base of the labeler assembly and sliding or lifting the base of the laser coder and the laser coder away from the labeler assembly. This process is typically complicated and lengthy, thus necessitating a relatively large amount of downtime.

In addition, the base of the laser coder typically occupies a relatively large amount of space on the machine floor. As a result, it is usually difficult to gain access to portions of the machine floor beneath and/or around the base of the laser coder when it is desired to clean the machine floor (e.g., after spillage of the beverage contained in the bottles).

SUMMARY OF THE INVENTION

The present invention provides, in one aspect, a coder assembly for printing on containers or on labels that can be applied to containers. The coder assembly includes a base, a support member movably coupled to the base, and a coder supported by the support member and movable with the support member relative to the base.

The present invention provides, in another aspect, a coder assembly for printing on containers or on labels that can be applied to containers. The coder assembly includes a base having a bottom surface supported by a machine surface, a coder, and a support member configured to support the coder. The support member is cantilevered from the base and spaced from the machine surface such that no portion of the support member or the coder is in contact with the machine surface.

The present invention provides, in yet another aspect, a method of positioning a coder used for printing on containers or on labels that can be applied to containers. The method includes positioning the coder on a support member that is movably coupled to a base supporting the support member. The support member is movable between a locked position, in which the support member is substantially immovable with respect to the base, and an unlocked position, in which the support member is movable with respect to the base. The method also includes unlocking the support member from the base and moving the support member and the coder relative to the base.

Other features and aspects of the present invention will become apparent to those skilled in the art upon review of the following detailed description, claims and drawings.

BRIEF DESCRIPTION OF THE DRAWINGS

In the drawings, wherein like reference numerals indicate like parts.

Figure 1:
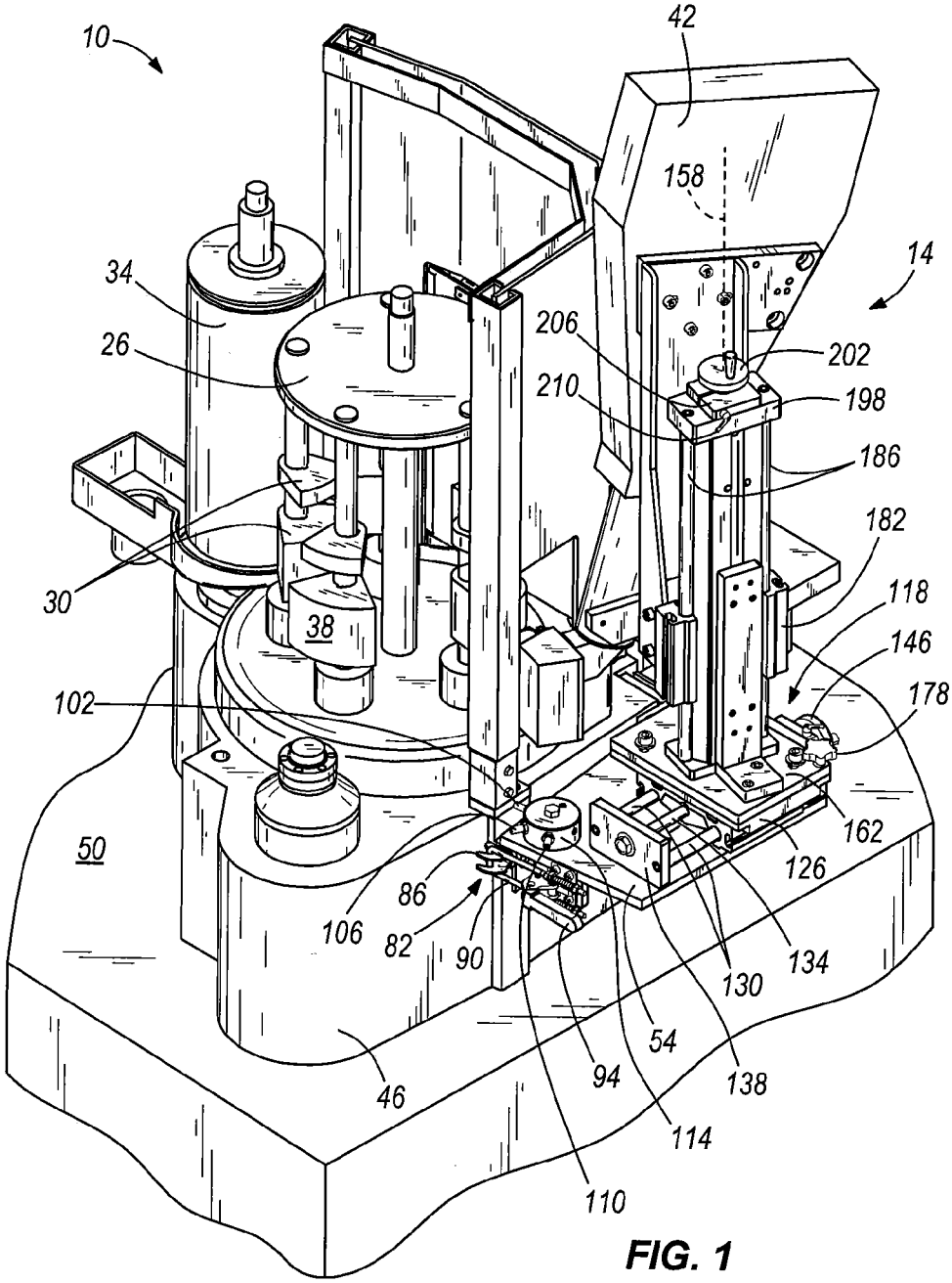
FIG. 1 is a front perspective view of a labeler assembly including a coder assembly of the present invention.

Before any features of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having", and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

With reference to FIGS. 1-4, a labeler assembly 10 is shown incorporating a coder assembly 14 of the present invention. The illustrated coder assembly 14 is a laser coder assembly 14, however, it is to be understood that other types of coders (e.g., ink jet coders) can also be used. Generally, the labeler assembly 10 is configured to individually remove labels from a stack of labels 18 (see FIGS. 2 and 3), apply adhesive or glue to the labels 18, and imprint the labels 18 with information specific to the bottles or other containers on which the labels 18 are applied. Such information may include, for example, the particular bottling date (i.e., the "born-on" date) of the beverage contained in the bottle. The labeler assembly 10 may be a component of a bottling machine (not shown), and positioned in a location adjacent to other bottling machine components configured to receive the imprinted labels 18 from the labeler assembly 10.

Figure 2:
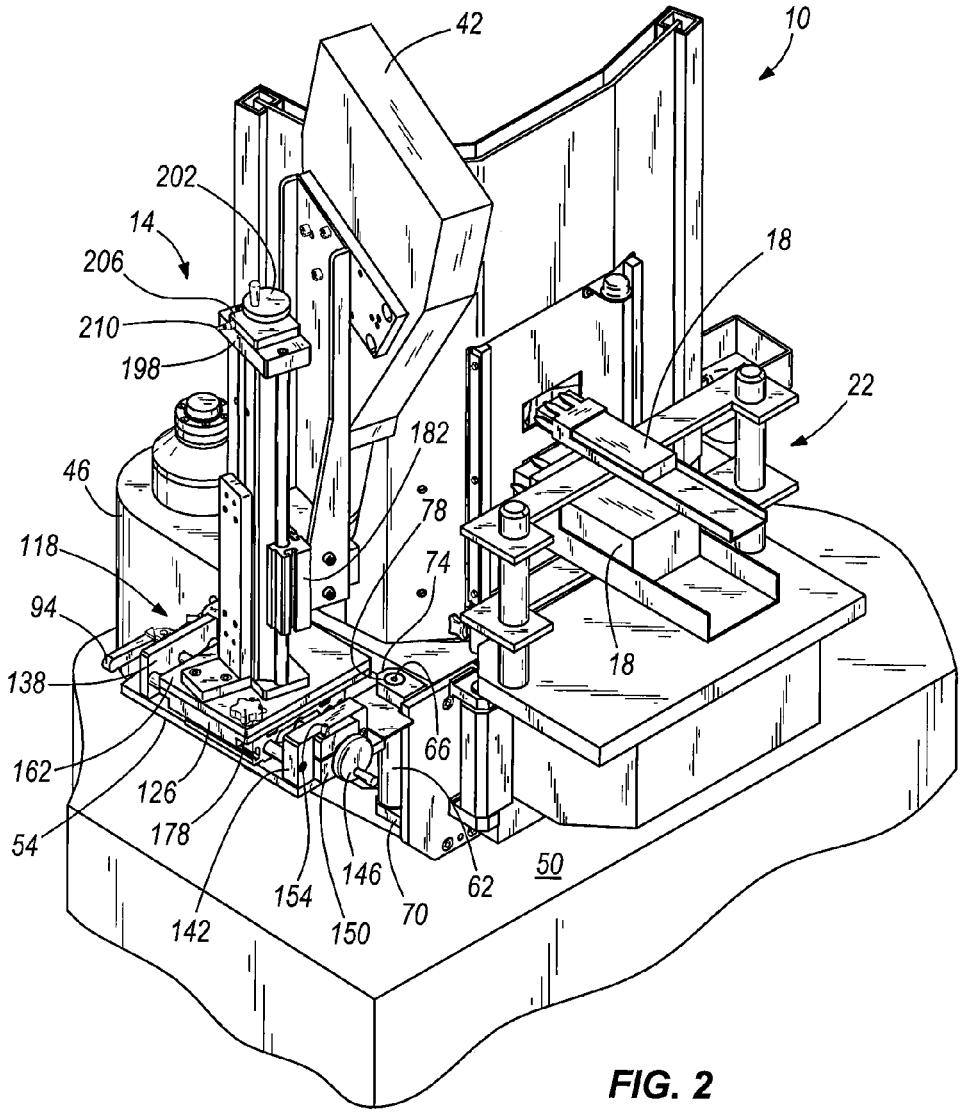
FIG. 2 is a rear perspective view of the labeler assembly of FIG. 1.
Figure 3:
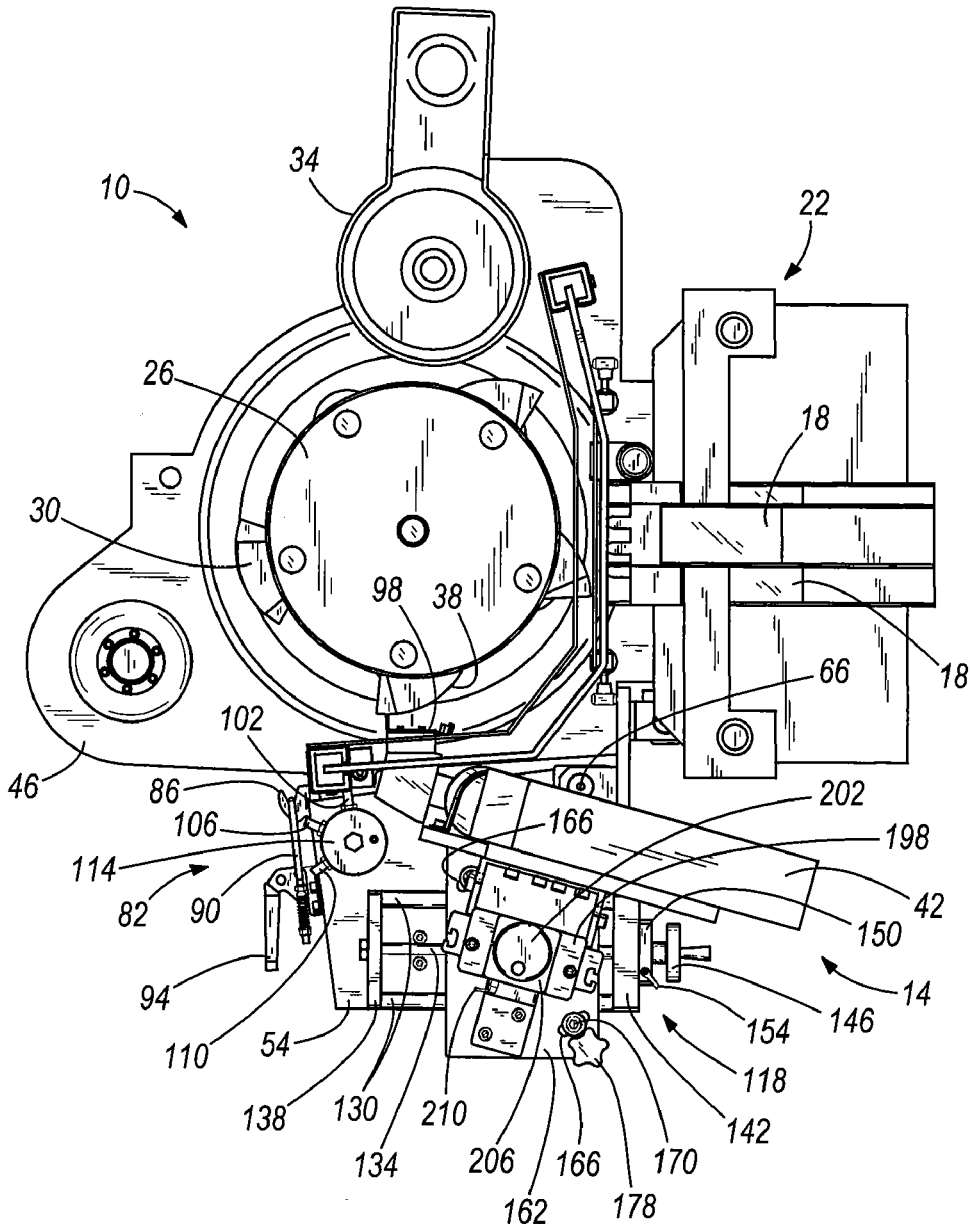
FIG. 3 is a top view of the labeler assembly of FIG. 1.
Figure 4:
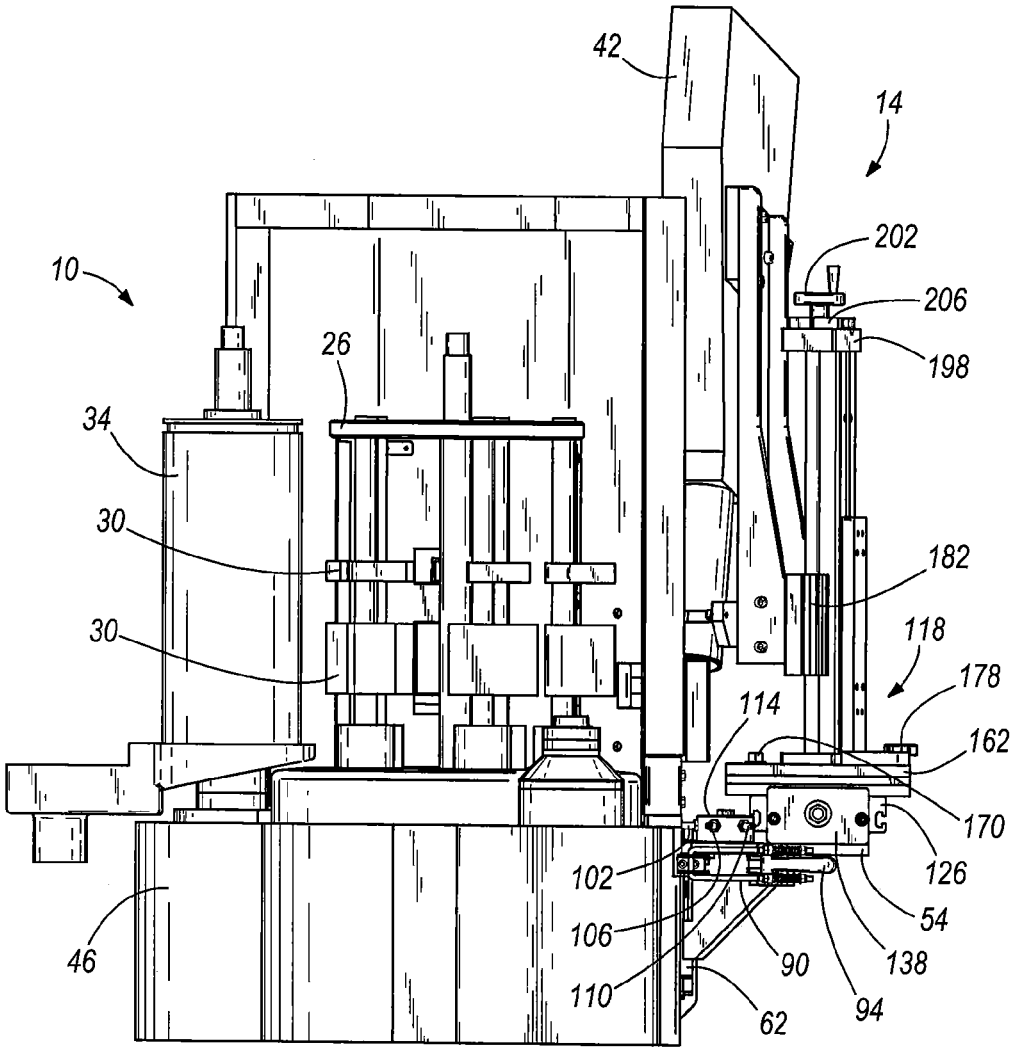
FIG. 4 is a front view of the labeler assembly of FIG. 1.

With reference to FIG. 2, the labeler assembly 10 includes a feeding device 22 for feeding the stack of labels 18 into the labeler assembly 10. As shown in FIG. 1, the labeler assembly 10 may also include a rotatable carousel 26 carrying a plurality of pallets 30 for individually removing labels from the stack of labels 18 fed by the feeding device 22. An adhesive roller 34 may be positioned adjacent the carousel 26, such that the individual pallets 30 pick up adhesive or glue from the adhesive roller 34 on curved surfaces 38 of the pallets 30. With reference to FIG. 3, clockwise rotation of the carousel 26 allows the individual pallets 30 to pick up adhesive from the adhesive roller 34 before the pallets 30 pick up a single label 18 from the stack of labels 18. Further clockwise rotation of the carousel 26 transports the label 18 to a position where it is imprinted by a laser coder 42. Continued clockwise rotation of the carousel 26 transports the imprinted label 18 to a position where it may be picked up by either another component (not shown) in the bottling machine for further transport or a container or a bottle for direct application thereto.

As shown in FIGS. 1 and 2, a base 46 (sometimes referred to as an "aggregate housing" by those skilled in the art) is supported on an elevated machine surface 50 of the bottling machine. The other components of the bottling machine may also be supported on the elevated machine surface 50. The machine surface 50 may include a stainless steel surface to provide corrosion resistance for spilled beverage product on the machine surface 50. Alternatively, the machine surface 50 may include a surface made from other corrosion-resistant materials.

The laser coder assembly 14 includes the laser coder 42 and a support member 54 for carrying the laser coder 42. The illustrated laser coder 42 is manufactured by Domino Amjet Inc. of Gurnee, Ill. Alternatively, the laser coder assembly 14 may be configured to utilize a LASETEC laser coder manufactured by Industrial Dynamics Co. Ltd. of Torrance, Calif. Further, as previously mentioned, other laser coders or ink jet printing devices may be utilized in place of the illustrated laser coder 42.

The support member 54 is cantilevered from the base 46 such that no portion of the support member 54 is in contact with the machine surface 50. By elevating the support member 54 and the laser coder 42 from the machine surface 50, additional space on the machine surface 50 is cleared. As a result, operators may gain increased access to the labeler assembly 10 and/or the laser coder assembly 14 for cleaning either of the assemblies 10, 14 or for cleaning spilled beverage product and/or other debris on the machine surface 50.

The support member 54 is movably coupled to the base 46, such that the laser coder 42 is movable with respect to the other components of the labeler assembly 10. In other words, the support member 54 is movably coupled with respect to the base 46 such that no labor-intensive process (i.e., a process similar to that used in the prior art) is required to separate and move the support member 54 with respect to the base 46. Neither the support member 54 nor the laser coder assembly 14 require unbolting, sliding, or lifting to be moved with respect to the base 46.

Figure 7:
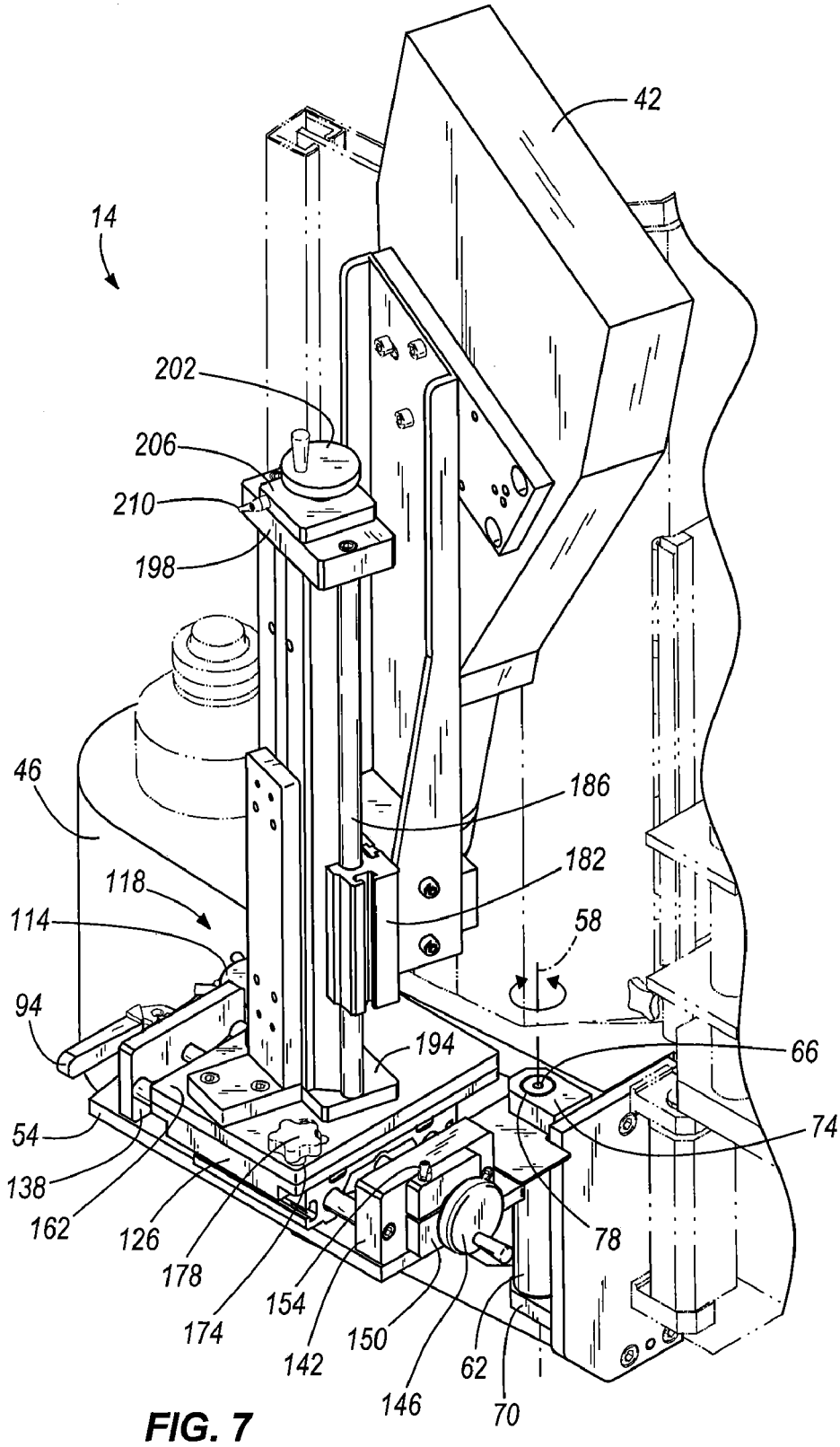
FIG. 7 is an enlarged, partial rear perspective view of the coder assembly shown in FIG. 1, illustrating the pivoting structure of the support member.

As best illustrated in FIG. 7, the support member 54 is pivotally coupled to the base 46 about a pivot axis 58. A portion of the support member 54 is comprised of a section of tubing 62 that receives a shaft or pin 66. The tubing 62 is positioned between spaced flanges 70, 74 mounted to the base 46, and the tubing 62 is axially aligned with a circular recess (not shown) formed in the lower flange 70 and an aperture 78 in the upper flange 74. The pin 66 may be inserted through the aperture 78 in the upper flange 74, through the circular tubing 62 of the support member 54, and engaged with the recess formed in the lower flange 70, thus pivotally coupling the support member 54 to the base 46. Alternatively, the support member 54 may be pivotally coupled to the base 46 utilizing any of a number of different structures and/or components (e.g., suitable hinge constructions, turntable constructions, etc.). Further, the support member 54 may be substantially linearly movable with respect to the base 46. Any suitable mechanisms (e.g., sliding rails, scissors mechanisms, extensible cylinders, etc.) can be used to achieve such linear movement.

Figure 5:
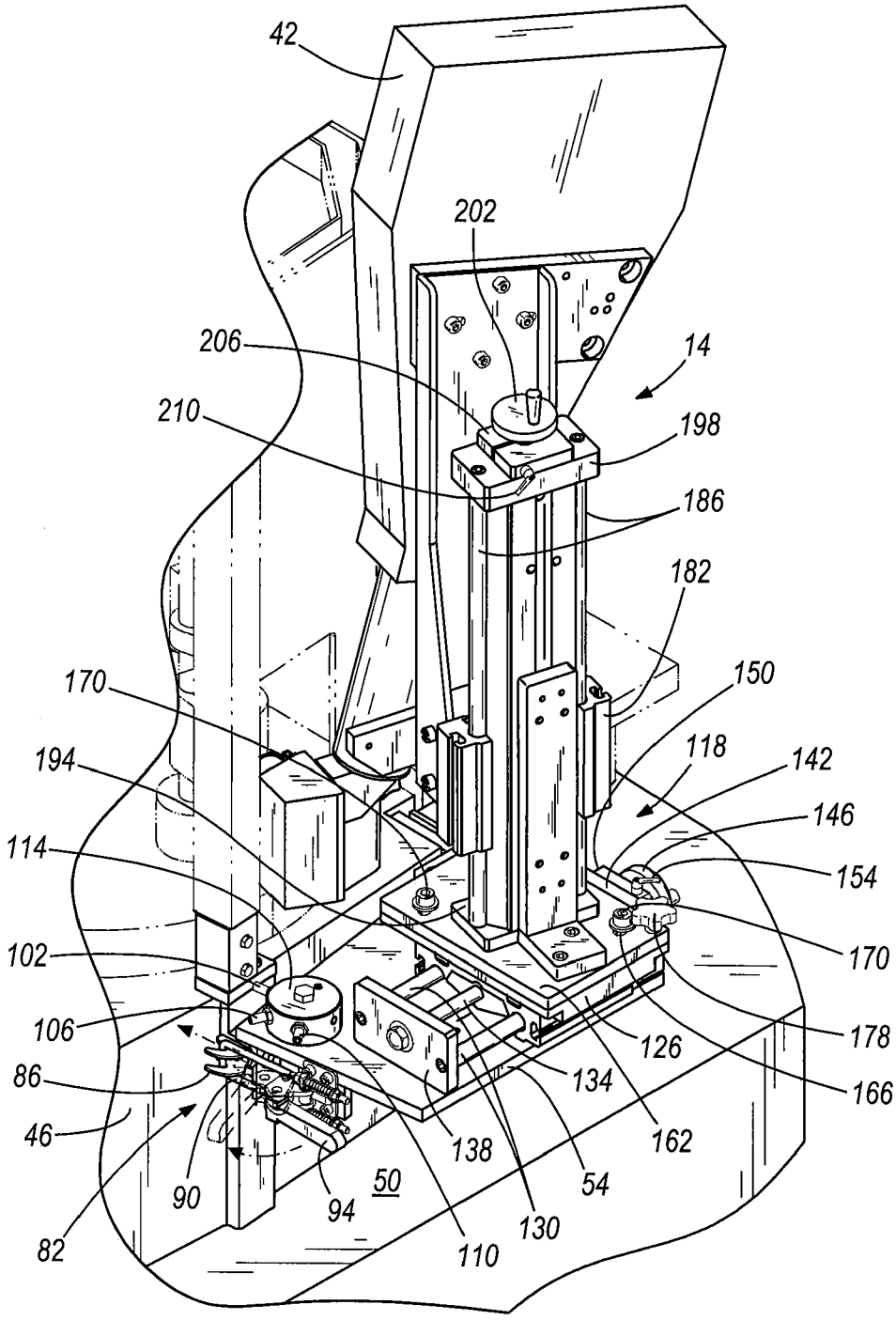
FIG. 5 is an enlarged, partial front perspective view of the coder assembly shown in FIG. 1, illustrating a latch mechanism locking a support member to a base.
Figure 6:
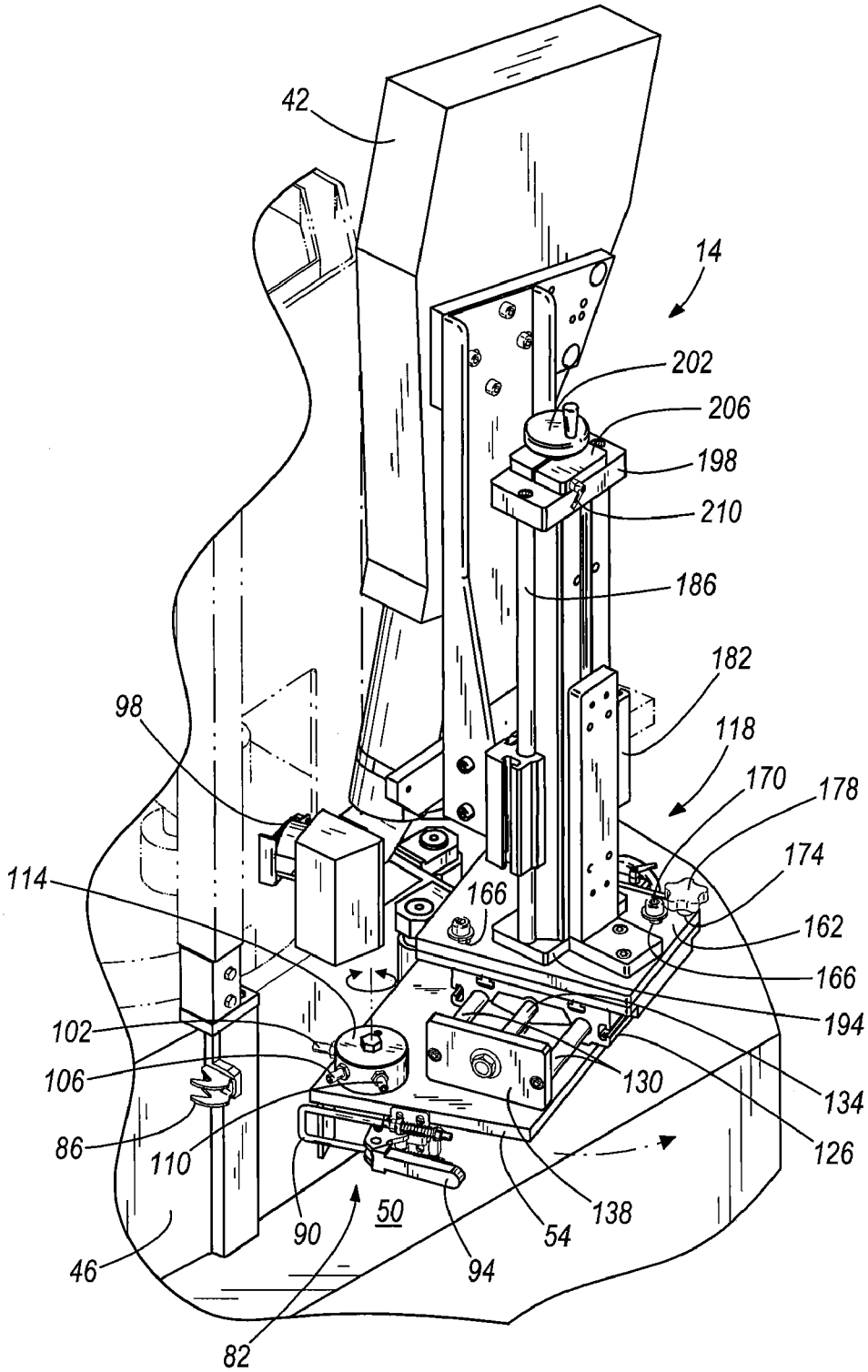
FIG. 6 is an enlarged, partial front perspective view of the coder assembly shown in FIG. 1, illustrating the latch mechanism unlocked to allow the support member to pivot relative to the base.

With reference to FIGS. 5 and 6, a latch mechanism 82 is operable to selectively lock the support member 54 to the base 46. In the illustrated construction, the latch mechanism 82 includes a hook 86 mounted to the base 46 and a latch 90 manipulatable by a lever 94. As shown in FIG. 5, to unlock the support member 54 from the base 46, the lever 94 may be pivoted away from the support member 54. Pivoting the lever 94 causes the latch 90 to move out of engagement with the hook 86 to allow the support member 54 to pivot freely about the pivot axis 58 and generally away from the base 46, as shown in FIG. 6. Using the illustrated latch mechanism 82, unlocking the support member 54 from the base 46 may be performed without the use of hand tools. The illustrated latch mechanism 82 is available from Heinrich Kipp Werk of Sulz (Neckar), Germany. Alternatively, any of a number of different latch mechanism configurations may be utilized to lock the support member 54 to the base 46.

The pivotal support member 54 allows the laser coder 42 to be pivoted away from the labeler assembly 10 to expose a laser lens 98 (see FIG. 6) of the laser coder 42. This allows an operator to relatively quickly and easily gain access to the lens 98 of the laser coder 42 for cleaning, if the lens 98 were to become contaminated by debris. Also, this allows an operator to gain access to the confined area between the lens 98 and the pallets 30 to clear label jams or to repair and/or replace the lens 98. After cleaning/replacing/repairing the lens 98 and removing any debris, the laser coder 42 may be returned to its designated operating position by pivoting the support member 54 toward the base 46. To stabilize the position of the lens 98, the latch mechanism 82 may be used to lock the support member 54 to the base 46.

With continued reference to FIGS. 5 and 6, a plurality of abutment members 102, 106, 110 may be positioned between the support member 54 and the base 46 to limit the relative movement and spacing between the support member 54 and the base 46. In the illustrated construction, the abutment members 102, 106, 110 are carried on a rotatable turret 114 mounted on the support member 54, such that any one of the plurality of abutment members 102, 106, 110 may be positioned between the turret 114 and the base 46 to define or maintain the desired spacing between the remainder of the support member 54 and the base 46. In the illustrated construction, the abutment members 102, 106, 110 are in the form of set screws that are threadably adjustable with respect to the turret 114 to provide a plurality of different extended lengths. The abutment members 102, 106, 110 may be sized in length according to any number of designated operating positions of the lens 98 with respect to the labels 18 to be imprinted. More particularly, the abutment members 102, 106, 110 provide fine adjustment of the focal point of the lens 98 on the label 18 to clearly imprint the labels 18.

For example, in a first production run of labels 18, in which the lens 98 should be spaced from the labels 18 to achieve a first focal point on the labels 18 to clearly imprint information (e.g., born-on dates), the support member 54, and therefore the lens 98, may be located in a first operating position by a first abutment member 102. Likewise, in a second production run of labels 18, in which the lens 98 should be spaced from the labels to achieve a second focal point on the labels 18 to clearly imprint information, the support member 54, and therefore the lens 98, may be located in a second operating position by a second abutment member 106 having a different length than the first abutment member 102.

By incorporating the abutment members 102, 106, 110 on the turret 114, the laser coder assembly 14 may be relatively quickly and easily reconfigured for different production runs of labels 18. To reconfigure the laser coder assembly 14, an operator may unlock the support member 54 from the base 46 by unlatching the latch mechanism 82, pivot the support member 54 away from the base 46, manually rotate the turret 114 (i.e., without using hand tools) to the desired length abutment member 102, 106, 110, pivot the support member 54 back toward the base 46 until the newly-chosen abutment member 102, 106, 110 abuts the base 46 to limit the movement of the support member 54, and lock the support member 54 to the base 46 by latching the latch mechanism 82. The latch 90 includes threaded portions to allow adjustment of the latch 90 to adapt to whichever abutment member 102, 106, 110 is used. However, if only small differences between the abutment members 102, 106, 110 exists, the latch 90 may not require adjustment to provide sufficient engagement between the latch 90 and the hook 86.

Although the illustrated turret 114 incorporates three abutment members 102, 106, 110, alternative constructions of the turret 114 may incorporate any number of abutment members 102, 106, 110. Also, alternative constructions of the laser coder assembly 14 may position the turret 114 on the base 46 rather than on the support member 54, such that the abutment members 102, 106, 110 on the turret 114 abut the support member 54 when the support member 54 is pivoted toward the base 46. Further, alternative constructions of the laser coder assembly 14 may position the turret 114 on an intermediate component between the base 46 and support member 54.

With reference to FIGS. 5-9, the laser coder assembly 14 includes an adjustment mechanism 118 coupled between the laser coder 42 and the support member 54. The adjustment mechanism 118 may be used to adjust the position of the laser coder 42, and more particularly the laser lens 98, with respect to the base 46. The adjustment mechanism 118 may be used to make either large adjustments or fine adjustments of the position of the lens 98 with respect to the passing-by labels 18.

Figure 8:
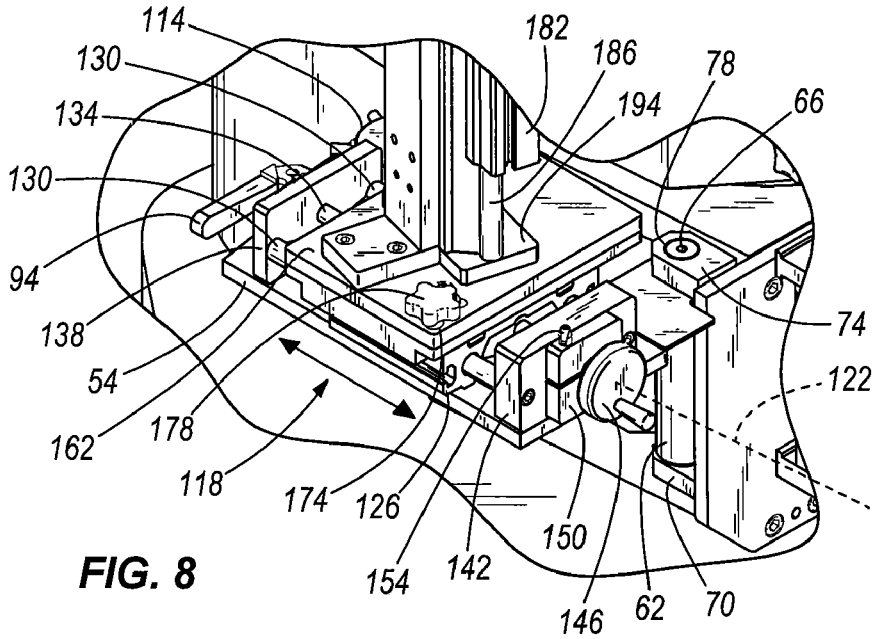
FIG. 8 is an enlarged, partial rear perspective view of a lower portion of an adjustment mechanism supporting the coder shown in FIG. 1.

With reference to FIG. 8, the adjustment mechanism 118 is operable to move the laser coder 42 along a substantially horizontal axis 122. To provide such movement along the horizontal axis 122, the adjustment mechanism 118 includes a carriage 126 that is slidable along a first set of parallel rails 130 and movable by a rotating screw 134 threadably engaged with the carriage 126. The rails 130 are supported at their opposite ends by respective blocks 138, 142, which, in turn, are mounted to the support member 54. The screw 134 is also supported at its opposite ends by the respective blocks 138, 142, and the screw 134 is supported for rotation in the blocks 138, 142 (e.g., by bearings, etc.). A crank 146 is secured to one end of the screw 134 to allow an operator to rotate the screw 134. A locking device 150 may be used to selectively lock the screw 134 against rotation, thus maintaining the laser coder 42 in a particular location along the horizontal axis 122. A knob or lever 154, such as that shown in FIG. 8, may be turned by the operator without using hand tools to selectively actuate the locking device 150 to lock or unlock rotation of the screw 134. Alternatively, an electric servo-motor may be utilized to drive the screw 134 in place of the crank 146. The servo-motor may include an internal braking or locking mechanism, such that the locking device 150 may not be required.

With reference to FIG. 1, the adjustment mechanism 118 is also operable to rotate the laser coder 42 about a substantially vertical axis 158. To provide such movement about the vertical axis 158, the adjustment mechanism 118 includes a table 162 that is fastened to the top of the carriage 126. As best shown in FIG. 3, the table 162 includes arcuate or curved slots 166 at opposite corners of the table 162. Both of the slots 166 define substantially the same radius of curvature, such that both of the radii defining the slots 166 share the same center point or origin, which lies on the vertical axis 158.

Fasteners 170, such as cap screws, may be inserted through the slots 166 and threadably engaged with the carriage 126. Upon loosening of the fasteners 170, the table 162 may be rotated about the vertical axis 158 by an amount dictated by the length of the slots 166. As a result of rotating the table 162, the angular orientation of the laser coder 42, and more particularly the laser lens 98, may be adjusted in either large increments or fine increments.

The adjusting mechanism 118 may also include a temporary locking member, such as a setscrew 174, that is threadably engaged with the table 162 for frictional abutment with the carriage 126. The setscrew 174 may include a knob 178 to be grasped by the operator for tightening or loosening the setscrew 174. For an operator to adjust the angular orientation of the lens 98 about the vertical axis 158, the operator may grasp the knob 178 to loosen or back-out the setscrew 174 from abutment with the carriage 126, loosen the fasteners 170 using hand tools, angularly adjust the table 162 (and thus the lens 98) about the vertical axis 158, grasp the knob 178 and tighten the setscrew 174 into abutment with the carriage 126 to temporarily maintain the angular adjustment of the table 162, and tighten the fasteners 170 using hand tools to positively secure the table 162 to the carriage 126.

Figure 9:
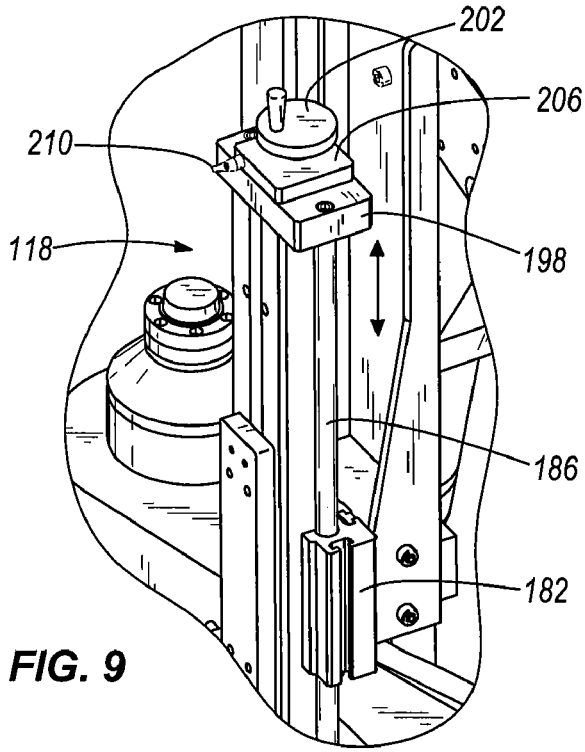
FIG. 9 is an enlarged, partial rear perspective view of an upper portion of the adjustment mechanism supporting the coder shown in FIG. 1.

With reference to FIG. 9, the adjustment mechanism 118 is also operable to move the laser coder 42 along the substantially vertical axis 158. To provide such movement along the vertical axis 158, the adjustment mechanism 118 includes a second carriage 182 that is slidable along a second set of parallel rails 186 and movable by a second rotating screw (not shown) threadably engaged with the carriage 182. The rails 186 and the screw are supported at their opposite ends by respective blocks 194, 198. The lower block 194 is mounted to the table 162, while the upper block 198 is vertically spaced from the lower block 194. Like the first screw 134, the second screw is supported for rotation in the blocks 194, 198 (e.g., by bearings, etc.). A second crank 202 is secured to one end of the second screw to allow an operator to rotate the second screw. A second locking device 206 may be used to selectively lock the second screw against rotation, thus maintaining the laser coder 42 in a particular location along the vertical axis 158. A second knob or lever 210, such as that shown in FIG. 9, may be turned by the operator without using hand tools to selectively actuate the second locking device 206 to lock or unlock rotation of the second screw. Alternatively, a second electric servo-motor may be utilized to drive the second screw in place of the second crank 202. The second servo-motor may include an internal braking or locking mechanism, such that the second locking device 206 may not be required.

The illustrated laser coder 42 is supported by the adjustment mechanism 118 in a substantially upright orientation. By supporting the laser coder 42 in a substantially upright orientation, the center of mass of the laser coder 42 is moved closer toward the base 46. As a result, the bending moment applied to the support member 54 by the substantially vertically-oriented laser coder 42 may be less than the bending moment applied by a substantially horizontally-oriented laser coder.

Although the laser coder assembly 14 is shown with the labeler assembly 10 in the illustrated constructions of FIGS. 1-9, the laser coder assembly 14 may alternatively be positioned in different locations in the bottling machine. For example, the laser coder assembly 14 may be positioned in the bottling machine such that the labels 18 are imprinted after the labels 18 are applied to the bottles. Also, for example, the laser coder assembly 14 may be positioned in the bottling machine to print directly on the bottles (i.e., without using labels).

Various features of the invention are set forth in the following claims.

I claim:

1. A coder assembly for printing on containers or on labels that can be applied to containers, the coder assembly comprising:

a base;

a support member pivotably coupled to the base and cantilevered from the base;

a coder supported by the support member and movable with the support member relative to the base; and an adjustment mechanism coupled between the coder and the support member and configured to adjust the position of the coder with respect to the base and the support member;

wherein the adjustment mechanism is operable to move the coder along at least one of a substantially horizontal axis and a substantially vertical axis without using tools.

2. The coder assembly of claim 1, wherein the adjustment mechanism is operable to permit rotation of the coder about a substantially vertical axis.

3. The coder assembly of claim 1, wherein the coder assembly is adapted to be used with a bottling machine, the bottling machine defining a machine surface, and wherein the base is supported on the machine surface.

4. The coder assembly of claim 3, wherein the support member is spaced from the machine surface such that no portion of the support member or the coder is in contact with the machine surface.

5. The coder assembly of claim 1, further comprising a latch mechanism selectively locking the support member to the base so that the support member is substantially immovable with respect to the base.

6. The coder assembly of claim 5, wherein the latch mechanism is operable to selectively lock and unlock the support member without using tools.

7. The coder assembly of claim 1, further comprising a plurality of abutment members between the support member and the base, wherein the abutment members are configured to limit the spacing between the support member and the base.

8. The coder assembly of claim 7, wherein the plurality of abutment members are carried on a turret, and wherein the turret is adjustable to selectively position any one of the plurality of abutment members between the support member and the base.

9. The coder assembly of claim 7, wherein the plurality of abutment members comprise a plurality of set screws.

10. The coder assembly of claim 7, wherein a first abutment member spaces the support member from the base in a first operating position, and wherein a second abutment member spaces the support member from the base in a second operating position.

11. The coder assembly of claim 1, wherein the coder is supported by the support member in a substantially upright orientation.

12. The coder assembly of claim 1, wherein the coder is a laser coder.

13. The coder assembly of claim 1, wherein the support member is movable between a first operative position with respect to the base and a second operative position with respect to the base.

14. The coder assembly of claim 1, wherein the adjustment mechanism is operable to move the coder along the substantially horizontal axis and the substantially vertical axis without using tools.

15. A coder assembly for printing on containers or on labels that can be applied to containers, the coder assembly comprising:

a base;

a support member movably coupled to the base;

a coder supported by the support member and movable with the support member relative to the base; and a plurality of abutment members between the support member and the base, wherein the abutment members are configured to limit the spacing between the support member and the base;

wherein a first abutment member having a first length spaces the support member from the base in a first operating position, and wherein a second abutment member having a second length spaces the support member from the base in a second operating position.

16. The coder assembly of claim 15, wherein the support member is pivotally coupled to the base.

17. The coder assembly of claim 15, further comprising a latch mechanism selectively locking the support member to the base so that the support member is substantially immovable with respect to the base.

18. The coder assembly of claim 17, wherein the latch mechanism is operable to selectively lock and unlock the support member without using tools.

19. The coder assembly of claim 15, wherein the plurality of abutment members are carried on a turret, and wherein the turret is adjustable to selectively position any one of the plurality of abutment members between the support member and the base.

20. The coder assembly of claim 15, wherein the plurality of abutment members comprise a plurality of set screws.

21. The coder assembly of claim 15, further comprising an adjustment mechanism coupled between the coder and the support member and configured to adjust the position of the coder with respect to the base.

22. The coder assembly of claim 21, wherein the adjustment mechanism is operable to move the coder along a substantially horizontal axis and along a substantially vertical axis without using tools.

23. The coder assembly of claim 21, wherein the adjustment mechanism is operable to permit rotation of the coder about a substantially vertical axis.

24. The coder assembly of claim 15, wherein the coder is supported by the support member in a substantially upright orientation.

25. The coder assembly of claim 15, wherein the coder is a laser coder.

26. The coder assembly of claim 15, wherein the base has a bottom surface supported by a machine surface, and wherein the support member is cantilevered from the base and spaced from the machine surface such that no portion of the support member or the coder is in contact with the machine surface.

27. A coder assembly for printing on containers or on labels that can be applied to containers, the coder assembly comprising:

a base;

a support member movably coupled to the base;

a coder supported by the support member and movable with the support member relative to the base; and a plurality of abutment members between the support member and the base, wherein the abutment members are configured to limit the spacing between the support member and the base;

wherein the plurality of abutment members are carried on a turret, and wherein the turret is adjustable to selectively position any one of the plurality of abutment members between the support member and the base.

28. A coder assembly for printing on containers or on labels that can be applied to containers, the coder assembly comprising:

a base having a bottom surface supported by a machine surface;

a coder;

a support member configured to support the coder, the support member cantilevered from the base and spaced from the machine surface such that no portion of the support member or the coder is in contact with the machine surface; and a plurality of abutment members between the support member and the base, wherein the abutment members are configured to limit the spacing between the support member and the base;

wherein the plurality of abutment members are carried on a turret, and wherein the turret is adjustable to selectively position any one of the plurality of abutment members between the support member and the base.

* * * * *